US005536211A

United States Patent [19]

Kelly

[11] Patent Number: 5,536,211

[45] Date of Patent: Jul. 16, 1996

[54] PINSETTER DIRT AND DEBRIS CATCH PAN

[76] Inventor: Michael W. Kelly, 302 6th St. Apt. 2, Glassport, Pa. 15045

[21] Appl. No.: 352,512

[22] Filed: Dec. 9, 1994

[51] Int. Cl.[6] ..... A63D 5/00

[52] U.S. Cl. ..... 473/54; 473/73

[58] Field of Search ..... 473/54, 73, 86, 473/87, 88, 89, 90, 91; 184/106; 220/571, 4.01, 4.26, 4.27, 4.33, 500; 15/257.1; 126/51

[56] References Cited

U.S. PATENT DOCUMENTS 3,661,227 5/1972 Robel et al. ..... 184/106

4,484,661 11/1984 Evenson ..... 184/106

*Primary Examiner*—William M. Pierce

[57] ABSTRACT

A catch pan assembly for placement under the lower framework of a bowling machine and shaped to cover the floor area on which dirt and other debris would otherwise fall onto.

7 Claims, 1 Drawing Sheet

PINSETTER DIRT AND DEBRIS CATCH PAN

BACKGROUND OF THE INVENTION

In a bowling machine, there is a constant flow of dirt, oil and dust which travels down the bowling lane and into the pit area of the bowling machine which makes the bowling machine run less efficiently. Also fallen bolts, nuts, springs, tools etc. cannot be retrieved with ease.

SUMMARY OF THE INVENTION

A removable catch pan assembly for a bowling machine pinsetter to be placed under the lower framework of a bowling machine, comprising a four pan unit which, when placed in their respective places and fastened together, will become a unitary structure to catch dirt, fallen bolts, nuts, springs etc. and debris. The catch pan assembly is so shaped as to cover the floor area onto which dirt and debris would otherwise fall.

DESCRIPTION OF THE PREFERRED EMBODIMENTS

Figure 1:
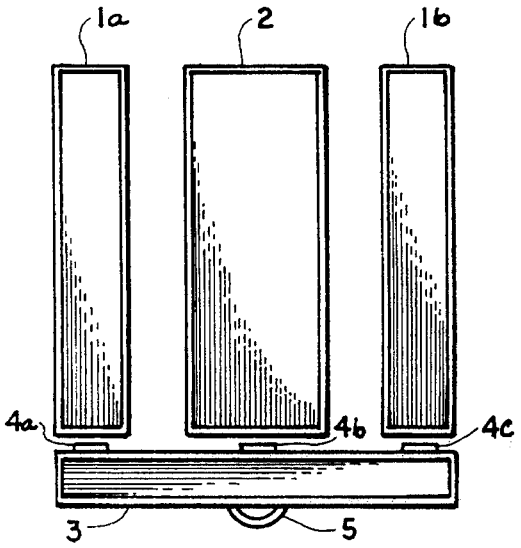
FIG. 1 is a top view of the four pan assembly of the present invention when disassembled.
Figure 2:
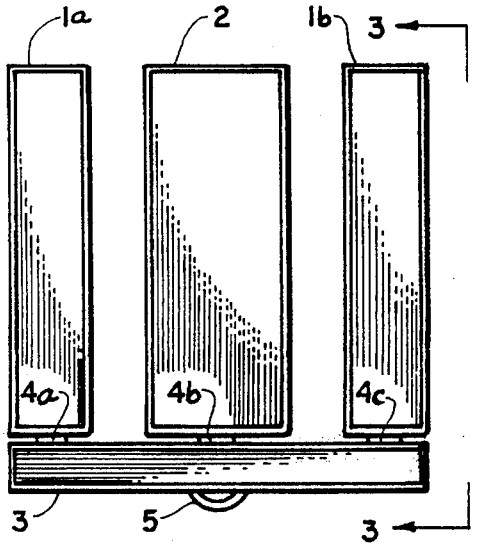
FIG. 2 is a top view of the catch pan assembly of FIG. 1 assembled.
Figure 3:
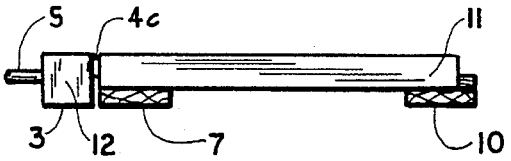
FIG. 3 is side view of the catch pan mounted on existing horizontal planks 7, 10 of the cross-section

The catch pan of the present invention, best shown in FIGS. 1–3, Inclusive, is comprised of four metallic plastic parts 1*a*, 1*b*, 2 and 3 shown separated in FIG. 1 and attached in FIGS. 2 and. 3, having integral side walls 11 and 12 which is (11) about 1 inch and (12) about 3½ inches in height.

Figure 4:
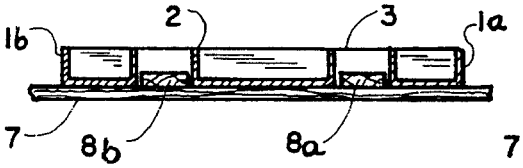
FIG. 4 is a rear view of the existing lower frame work and wood planks shown in cross-section.

When the pan is fully assembled as in FIG. 2 it will be placed under the lower framework, and on lower horizontal mounting planks 7 and 10 and between the submounting planks (8*a*) and (8*b*), on which the submounting plate is mounted too, as shown in FIG. 4, which enables the catch pan assembly to catch dirt and debris of the bowling machinery.

Figure 5:
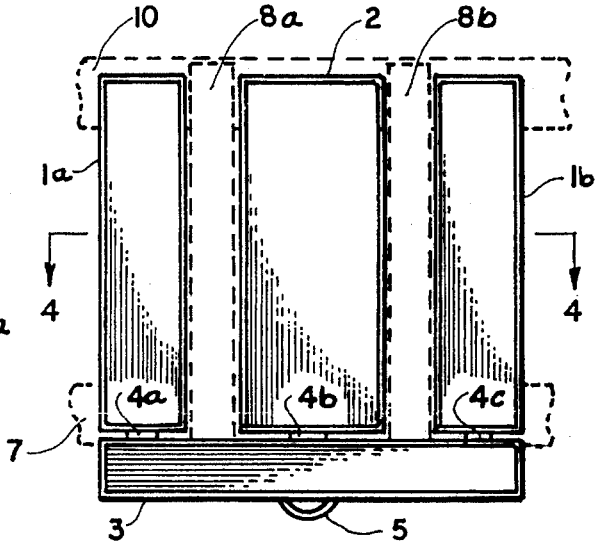
FIG. 5 is a plan view of the catch pan assembly of the present invention shown in full lines, fitted on and between the existing vertical wooden mounting planks shown in dash outline minus the lower framework of the bowling machine; said parts (1*a*) (1*b*) (2) & (3) may be made of one integral piece

FIG. 5 shows a fully assembled pan with parts (1*a*), (1*b*), (2) and (3) held together by fasteners (4*a*), (4*b*) and (4*c*) which may be of the hook and loop type sold under the trademark Velcro. Instead, any known readily detachable connection may be substituted. With the pans on top of the horizontal planks (7) and (10) and in their perspective slots between the vertical submounting wood planks (8*a*) and (8*b*) with a handle (5) for easy removal of the fully assembled pans from under the lower frame work of a bowling machine.

I claim:

1. In combination with a bowling machine having a lower framework, including lower parallel spaced, interconnected sub-mounting plates of a bowling machine pinsetter, a removable catch basin assembly comprising a plurality of parallel spaced pans joined together with an end plate at right angles to said pans, joining them together as a single unit and placed between said parallel spaced sub-mounting plates under said lower framework to catch falling debris.

2. The combination recited in claim 1 wherein said plurality of pans are detachably joined together.

3. The combination recited in claim 2 wherein hook and loop attaching means, known commercially as Velcro, are used as the detachable joining means.

4. The combination recited in claim 2 wherein said plurality of parallel spaced pans and said end plate are made as one integral piece not detachably joined together.

5. The combination recited in claim 1 together with a handle attached to a center of said end plate to facilitate removal of said catch basin.

6. The combination recited in claim 1 wherein said plurality of pans cover a floor area onto which debris would otherwise fall onto.

7. The combination recited in claim 1, wherein said end plate is a pan at right angles to said plurality of said parallel spaced pans.

* * * * *